US006527896B1

(12) United States Patent
Sawano

(10) Patent No.: US 6,527,896 B1
(45) Date of Patent: Mar. 4, 2003

(54) IMAGE TRANSFER METHOD AND IMAGE TRANSFER APPARATUS HAVING INSERTION TABLE THEREFOR

(75) Inventor: Mitsuru Sawano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 131 days.

(21) Appl. No.: 09/639,161

(22) Filed: Aug. 16, 2000

(30) Foreign Application Priority Data

Aug. 17, 1999 (JP) ..... 11-230754

(51) Int. Cl.[7] ..... B41M 5/025

(52) U.S. Cl. ..... 156/230; 156/240; 156/247; 427/146; 427/148

(58) Field of Search ..... 156/230, 231, 156/239, 240, 241, 247, 277; 427/146–148

(56) References Cited

U.S. PATENT DOCUMENTS 3,900,586 A * 8/1975 Wright ..... 101/DIG. 37
5,730,833 A * 3/1998 Hatakeyama et al. ..... 156/230

* cited by examiner

*Primary Examiner*—Sam Chuan Yao
(74) *Attorney, Agent, or Firm*—Sughrue & Mion, PLLC

(57) ABSTRACT

An image transfer apparatus is arranged in a manner that an image bearing sheet on which an image is formed and a sheet on which an image is to be transferred are laminated, and the two sheets thus laminated are passed between a pair of heat rollers from an insertion table thereby to transfer the image formed on the image bearing sheet on the sheet on which the image is to be transferred. The image bearing sheet is placed on the insertion table, then the sheet on which an image is to be transferred is laminated on the image bearing sheet, and the two sheets thus laminated are inserted between the pair of heat rollers.

7 Claims, 9 Drawing Sheets

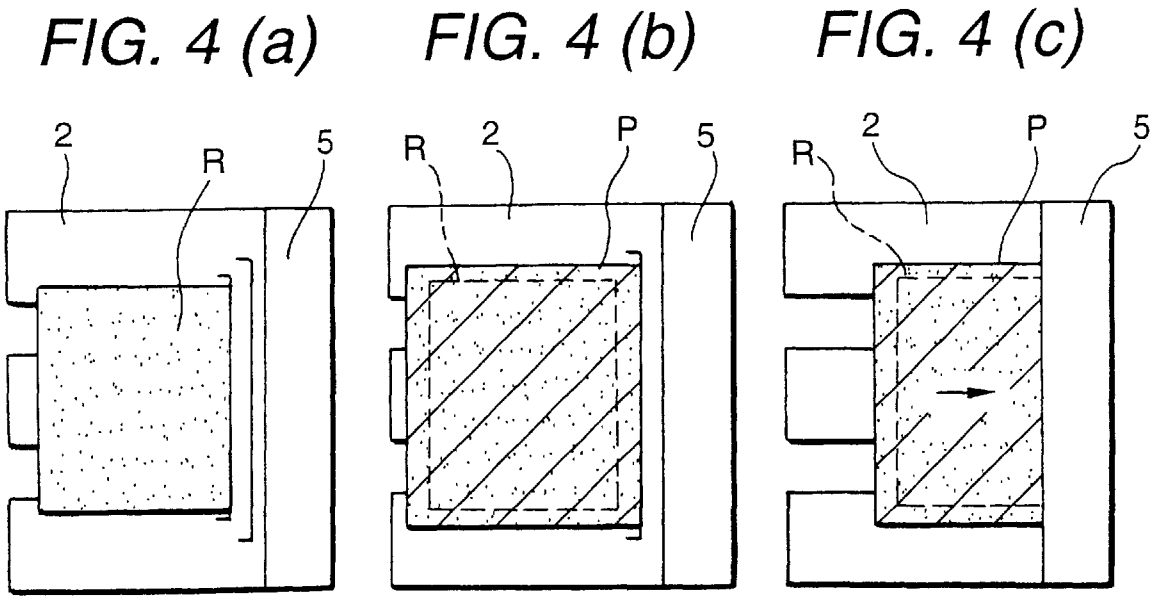
FIG. 4 (c)
FIG. 4 (b)
FIG. 4 (a)
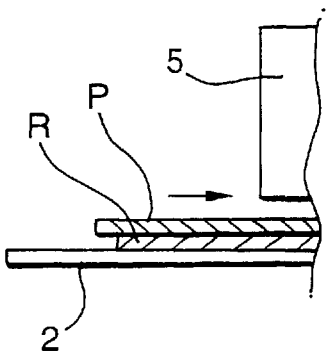
FIG. 4 (c')
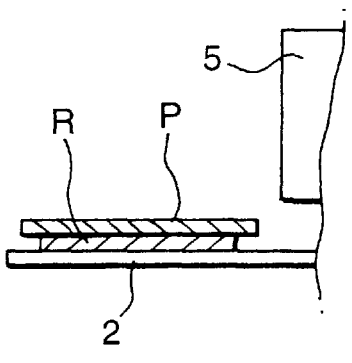
FIG. 4 (b')
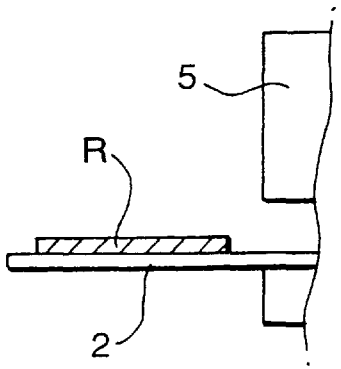
FIG. 4 (a')

PRIOR ART

FIG. 13

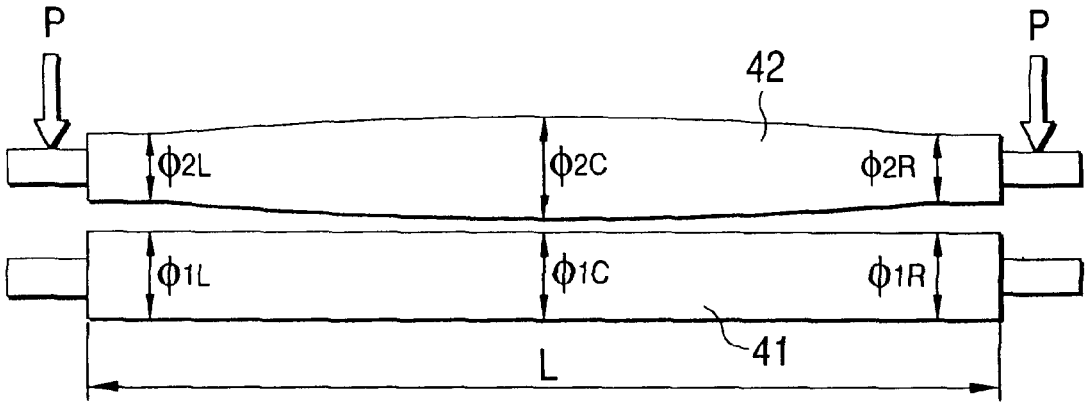

41 : HEAT ROLLER (STRAIGHT TYPE) COVERED BY SILICON RUBBER WITH THE HARDNESS OF 70 (DRIVING ROLLER)
42 : HEAT ROLLER (CROWN TYPE) COVERED BY SILICON RUBBER WITH THE HARDNESS OF 70 (DRIVEN ROLLER)
P : (PRESSING FORCE) = 20 Kg ± 4kgf
L : (ROLLER LENGTH) = 400 mm
$\phi_{1L}$ : (DIAMETER OF LEFT SIDE END PORTION OF STRAIGHT TYPE HEAT ROLLER) = 35.8 mm
$\phi_{1C}$ : (DIAMETER OF CENTER PORTION OF STRAIGHT TYPE HEAT ROLLER) = 35.8 mm
$\phi_{1R}$ : (DIAMETER OF RIGHT SIDE END PORTION OF STRAIGHT TYPE HEAT ROLLER) = 35.8 mm
$\phi_{2L}$ : (DIAMETER OF LEFT SIDE END PORTION OF CROWN TYPE HEAT ROLLER) = 35.8 mm
$\phi_{2C}$ : (DIAMETER OF CENTER PORTION OF CROWN TYPE HEAT ROLLER) = 36.1 mm
$\phi_{2R}$ : (DIAMETER OF RIGHT SIDE END PORTION OF CROWN TYPE HEAT ROLLER) = 35.8 mm

IMAGE TRANSFER METHOD AND IMAGE TRANSFER APPARATUS HAVING INSERTION TABLE THEREFOR

BACKGROUND OF THE INVENTION

1. Field of the Invention

The present invention relates to an image transfer apparatus in which an image bearing sheet, on which an image is formed by a thermal transfer printer or a laser thermal transfer printer (or any type of a printer such as an ink jet printer etc. which can transfer an image on a sheet to be transferred), and the sheet to be transferred are laminated and the two sheets thus laminated are passed between a pair of heat rollers thereby to transfer the image formed on the image bearing sheet on the sheet to be transferred.

2. Description of the Related Art

When preparing a printing plate from a color manuscript and forming many printed sheets based on the printing plate, proof print is performed to confirm the finished image and then the formal printing is performed. In this case, a color proof is prepared in the proof printing process and the finished image is confirmed. Such a color proof etc. is obtained in a manner that an image is thermally transferred on an image bearing sheet by a thermal printer etc. and the image formed on the image bearing sheet is transferred on a sheet on which the image is to be transferred (hereinafter called an image transfer sheet) by an image transfer apparatus.

FIG. 10 shows a conventional image transfer apparatus. In the figure, a reference numeral 1 depicts an image transfer apparatus. The image transfer apparatus 1 is provided with a pair of heat rollers 41, 42 disposed in an opposed manner along the vertical direction, and nip rollers 51, 52 disposed at the downstream side of the heat rollers in an opposed manner along the vertical direction. A heat cover 4 surrounds the heat rollers 41, 42 to prevent the heat dissipation from the heat rollers 41, 42. A protecting transfer cover 5 surrounds the outer side of the heat cover and the nip rollers 51, 52. An insertion table 2 is provided at the inlet side of the image transfer apparatus 1 and an ejection table 3 is provided at the ejection side thereof.

The heat rollers 41, 42 are formed by aluminum material etc., for example, and the outer peripheral surfaces thereof are covered by covering layers made of rubber etc. A heater is provided at the center portion of each of the heat rollers 41, 42. One (for example, the lower side roller) of the heat rollers 41, 42 disposed in an opposed manner along the vertical direction is a driving roller and the other thereof (the upper side roller) is a driven roller. Laminated two sheets of an image bearing sheet and an image transfer sheet are passed between the upper and lower heat rollers 41, 42 while being heated and pressed, so that an image of the image bearing sheet is transferred on the image transfer sheet. Thereafter, the image bearing sheet is manually peeled from the image transfer sheet, thereby to obtain the sheet on which the image is transferred.

Conventionally, the image transfer apparatus 1 has been employed in the following two manners so as to transfer an image.

1) One of the methods is arranged as shown in FIG. 11 in a manner that an image bearing sheet R is laminated on an image transfer sheet P, then the laminated sheets are passed as they are between the heat rollers 41, 42 while being heated and pressed thereby to transfer an image of the image bearing sheet R on the image transfer sheet P, then the laminated sheets are conveyed by the nip rollers 51, 52 and ejected from the ejection table 3. However, in this case, when the laminated sheets.are passed between the heat rollers, the image bearing sheet and the image transfer sheet are bent to form uneven wrinkles (hereinafter referred to wrinkles) thereon caused by the difference of amounts of expansion or shrinkage, the difference of thermal expansion coefficients, the difference of the coefficients of moisture absorption etc. between the image transfer sheet P and the image bearing sheet R due to the difference of the materials thereof.

2) In order to obviate such a problem, the other method using a carrier for the image transfer apparatus has been employed. FIG. 12 shows the laminating method using the image transfer apparatus carrier.

In the figure, a reference numeral 9 depicts the image transfer apparatus carrier which is configured by a carrier board 91 formed by aluminum etc. with a thickness of 0.3 mm, a cover sheet 92 formed by polyimide etc. with a thickness of 0.2 mm which covers only the vicinity of the tip portion of the carrier board 91 at the moving direction side thereof, and a heat-resistant tape 93 for fixing the cove sheet 92 to the carrier board 91.

The image transfer apparatus carrier 9 is employed in the following manner. First, the cover sheet 92 is opened, then laminated sheets of an image transfer sheet P and an image bearing sheet R are inserted between the cover sheet 92 and the carrier board 91, and the cover sheet 92 is closed thereby to sandwich the laminated two sheets from the major surface of the image bearing sheet and the rear surface of the image transfer sheet by the cover sheet and the carrier board. Then, in this state, the laminated two sheets held by the cover sheet and the carrier board are conveyed in a manner that the heat-resistant tape 93 side thereof is conveyed as the head toward and inserted between the heat rollers 41, 42.

When the image transfer apparatus carrier is employed in this manner, both the image transfer sheet P and the image bearing sheet R are sandwiched between the carrier board 91 and the cover sheet 92 and passed between the heat rollers 41, 42 while being held by the image transfer apparatus carrier 9. Thus, both the sheets can be prevented from causing the wrinkles.

SUMMARY OF THE INVENTION

However, although the wrinkles can be prevented from being caused by using the image transfer apparatus carrier 9, since the heat is absorbed by the aluminum board, the heat transmission efficiency to the laminated sheets is degraded, so that it is required to lower the conveying speed of the laminated sheets to about 1/10 of that of the conventional method. Otherwise, it is required to set the temperature of the heat rollers at the value higher than.that of the conventional method. Thus, there arises such a problem that the consumption of electricity increases, the heat insulated structure becomes exaggerative, and the heat-resistant temperature of the members to be used is required to be raised, or the like.

The invention has been made in view of the aforesaid problem, and an object of the present invention is to provide an image transfer method and an image transfer apparatus which can transfer an image on a sheet on which an image is to be transferred at a normal sheet conveying speed and with normal consumption amount of electricity without using an image transfer apparatus carrier and without causing wrinkles.

In order to attain the aforesaid object, an image transfer method according to the first aspect of the invention is arranged in a manner that in an image transfer method wherein an image bearing sheet on which an image is formed and a sheet on which an image is to be transferred are laminated, and the two sheets thus laminated are passed between a pair of heat rollers from an insertion table thereby to transfer the image formed on the image bearing sheet on the sheet on which the image is to be transferred, the method comprising the steps of:

placing the image bearing sheet on the insertion table;

laminating the sheet on which an image is to be transferred on the image bearing sheet; and inserting the two sheets thus laminated between the pair of heat rollers.

According to such an arrangement, since the sheet on which an image is to be transferred likely absorbing moisture is placed on the image bearing sheet, the moisture contained in the sheet on which an image is to be transferred will be evaporated therefrom upward and so both the sheets can be prevented from causing image transfer failure such as wrinkles. Further, such a phenomenon scarcely occurs that vapor stays between the two sheets thus laminated to partially cause the extension or shrinkage of the sheet on which an image is to be transferred thereby to occur the image transfer failure.

According to the second aspect of the invention, said step of inserting is a step of inserting the sheet and the image bearing sheet so that the sheet takes precedence over the image bearing sheet by a constant length.

According to the third aspect of the invention, said constant length is set so as to prevent a failure of the sheet and the image bearing sheet feeding called "jam".

According to the forth aspect of the invention, said insertion table is provided with marks thereon corresponding to a positional relation of the image bearing sheet and the sheet on which an image is to be transferred, said two sheets are inserted according to the marks.

According to the fifth aspect of the invention, 5. An image transfer apparatus method according to claim 1, wherein from the beginning of inserting step, until tip portions of the two sheets thus laminated are nipped by an operator.

According to the sixth aspect of the invention, said insertion table includes notch portions are arranged in a manner that an operator can hold the two sheets thus laminated.

According to the seventh aspect of the invention, the image bearing sheet and the sheet on which an image is to be transferred are laminated in such a positional relation that the sheet on which an image is to be transferred is inserted between the pair of heat rollers prior to the image bearing sheet by a length of 21 mm or more.

According to such an arrangement, the sheet conveying procedure can be scarcely failed and so the image transfer procedure can be performed satisfactorily between the image bearing sheet and the sheet on which an image is to be transferred.

According to the eighth aspect of the invention, an image transfer apparatus is arranged in a manner that an insertion table is provided with marks thereon corresponding to the positional relation of the image bearing sheet and the sheet on which an image is to be transferred.

According to such an arrangement, the satisfactory positional relation between the image bearing sheet and the sheet on which an image is to be transferred described above can be easily obtained by merely placing the image bearing sheet and the sheet on which an image is to be transferred in accordance with the marks.

According to the ninth aspect of the invention, an image transfer apparatus is arranged such that an insertion table includes notch portions which are arranged in a manner that an operator can hold the two sheets thus laminated until tip portions of the two sheets thus laminated are nipped.

According to such an arrangement, since the laminated sheets can be inserted in a level state without lifting them, the sheets scarcely cause the wrinkles. Further, since the laminated sheets are nipped when the rear ends of the laminated sheets reach the end portions of the notch portions of the insertion table, an operator may take the hands off the sheets at this time. Thus, the insertion procedure can be performed easily.

According to the tenth aspect of the invention, a mark indicative of a position of the leading edge of a main sheet on an insertion table is located downstream of a mark indicative of a position of the leading edge of an image receiving sheet as viewed in the transporting direction.

According to the eleventh aspect of the invention, said insertion table includes a cutout having a length long enough to hold an image receiving sheet and a main sheet, both being superimposed one on the other by an operator, till the leading edges of said image receiving sheet and said main sheet are nipped with a first nip roller pair.

With such a construction, the sheets being superimposed one on the other can automatically and horizontally be inserted into the nip roller pair by the belt conveyor. Therefore, there is little chance of creasing the sheets.

According to the twelfth aspect of the invention, said insertion table includes a slide table for transporting an image receiving sheet and a main sheet, both being superimposed one on the other, till the leading edges of said image receiving sheet and said main sheet are nipped by a first nip roller pair.

With such a construction, in a manner that after the image receiving sheet and the main sheet having been positioned to each other and superimposed one on the other are placed on the insertion table, the slide table is merely moved, those sheets being superimposed one on the other may reliably be fed into the nip roller pair. Therefore, those sheets are little creased.

BRIEF DESCRIPTION OF THE SEVERAL VIEWS OF THE DRAWINGS

FIGS. 4A to 4C and 4A' to 4C' are diagrams showing the procedure of inserting the laminated sheets into the image transfer apparatus using marks and the notch portions;

FIG. 13 is a diagram for explaining the configuration etc. of a pair of heat rollers used in the conventional image transfer apparatus.

DESCRIPTION OF THE PREFERRED EMBODIMENT

An image transfer method and an image transfer apparatus having an insertion table capable of executing the image transfer method will be explained in detail with reference to accompanying drawings.

Figure 1:
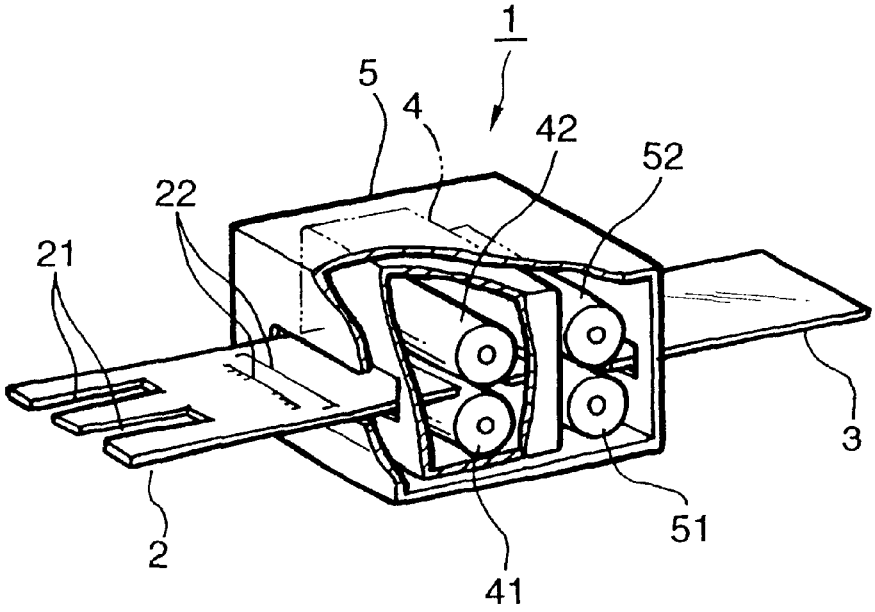
FIG. 1 is a partially sectional perspective view showing the image transfer apparatus according to an embodiment of the invention.

FIG. 1 is a partially sectional perspective view showing the image transfer apparatus according to an embodiment of the invention.

In FIG. 1, a reference numeral 1 depicts an image transfer apparatus according to the invention, which is configured by a pair of heat rollers 41, 42, a heat cover 4 surrounding the heat rollers, a pair of nip rollers 51, 52, a protection cover 5 surrounding the heat cover 4 and the pair of the nip rollers 51, 52, an insertion table 2 and an ejection table 3.

Another pair of nip rollers (not shown) are provided on the outer side of the heat cover 4 at the upstream of the pair of the heat rollers 41, 42, whereby laminated sheets of an image bearing sheet and a sheet on which an image is to be transferred (hereinafter called an image transfer sheet) can be surely nipped.

The pair of the nip rollers 51, 52 may be eliminated.

FIG. 13 is a diagram for explaining in detail the configuration etc. of the pair of the heat rollers 41, 42 shown in FIG. 1. The heat roller 41 is a driving roller of a straight type with a roller length of 400 mm (that is, a cylindrical type wherein the diameters $\phi$1L, $\phi$1R at the opposite ends of the heat roller 41 and the diameter $\phi$1C at the center portion thereof have the same value (for example, 35.8 mm)). The heat roller 42 is a driven roller of a crown type with a roller length of 400 mm (that is, a barrel type wherein the diameter $\phi$2C (for example, 36.1 mm) at the center portion of the heat roller 42 is slightly larger than the diameters $\phi$2L, $\phi$2R (for example, 35.8 mm) at the opposite ends thereof). Each of the heat rollers 41, 42 is covered by silicon rubber with the hardness of 70 (JIS A hardness).

Each of the opposite ends of the upper side heat roller 42 is applied with a force of 20±4 kgf as a pressing force P.

Since each of the pair of the heat rollers 41, 42 is supported at only two portions, that is, the opposite ends thereof, even if the center portion thereof is bent slightly, any portion of each of the pair of the heat rollers 41, 42 is applied with an uniform pressing force due to the aforesaid combination of the straight type and crown type rollers.

Figure 2:
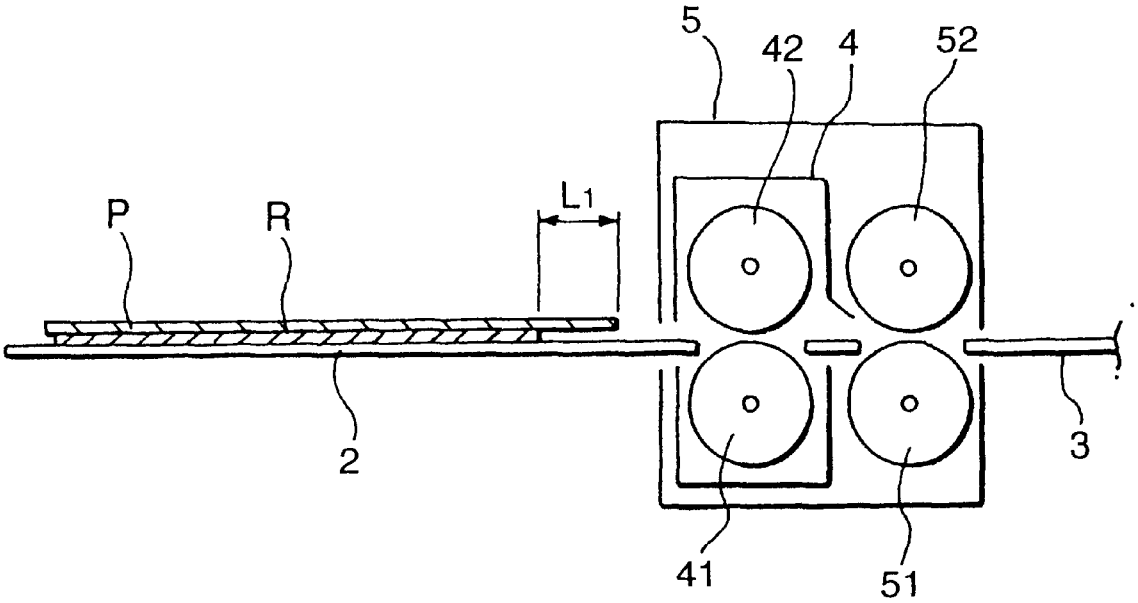
FIG. 2 is a diagram for explaining the image transfer method according to the first embodiment of the invention using the image transfer apparatus shown in FIG. 1.

FIG. 2 is a diagram showing the first embodiment in which the image transfer method according the invention is executed by using the image transfer apparatus shown in FIG. 1. In FIG. 2, a sheet R placed on the insertion table 2 of the image receiving apparatus is an image bearing sheet on which an image is formed, and a sheet P laminated thereon is an image transfer sheet. That is, in contrast to the conventional image transfer method (FIG. 7) where the image bearing sheet R on which the image is formed is laminated on the image transfer sheet P, in the image transfer method according to the invention, the image transfer sheet P is laminated on the image bearing sheet R.

In this manner, first, the image bearing sheet R is placed on the insertion table 2, then the image transfer sheet P is laminated thereon, and the two sheets thus laminated are inserted into the image transfer apparatus. In this case, since the image transfer sheet likely absorbing moisture is placed on the image bearing sheet, when the image transfer sheet is heated by the heat rollers 41, 42, the moisture contained in the image transfer sheet will be evaporated therefrom as vapor upward and so both the two sheets can be prevented from causing the wrinkles.

In contrast, in the conventional method, since the image transfer sheet is placed below the lower side of the image bearing sheet, when the image transfer sheet is heated by the heat rollers 41, 42, vapor evaporated from the image transfer sheet is prevented by the image bearing sheet from flowing upward. Thus, it seems that the vapor stays between the image transfer sheet and the image bearing sheet, thereby causing the extension or shrinkage of the image transfer sheet thereby to cause wrinkles etc. thereon.

In this case, as shown in FIG. 2, the image transfer sheet P and the image bearing sheet R are disposed in such a positional relation that the image transfer sheet P is preferably inserted in the image transfer apparatus prior to the image bearing sheet R by a length of L1 (L1=21 mm) or more. According to such a positional relation, only the image transfer sheet P is inserted prior to the image bearing sheet and succeedingly the laminated portion of the image transfer sheet and the image bearing sheet R is inserted, so that there scarcely arises the failure of sheet feeding (normally called "jam").

Further, according to the conventional method, since the image bearing sheet R having the smaller size than the image transfer sheet P is laminated on the image transfer sheet P, an operator can easily and visually grasp the positional relation of the sheets whether or not the image transfer sheet P is deviated from the image bearing sheet R by the length of 21 mm or more. In contrast, according to the method of the invention, since the image transfer sheet P having the larger size than the image bearing sheet R is laminated on the image bearing sheet R, it is difficult to visually grasp the positional relation of the sheets whether or not the image transfer sheet P is deviated from the image bearing sheet R by the length of 21 mm or more.

Figure 3:
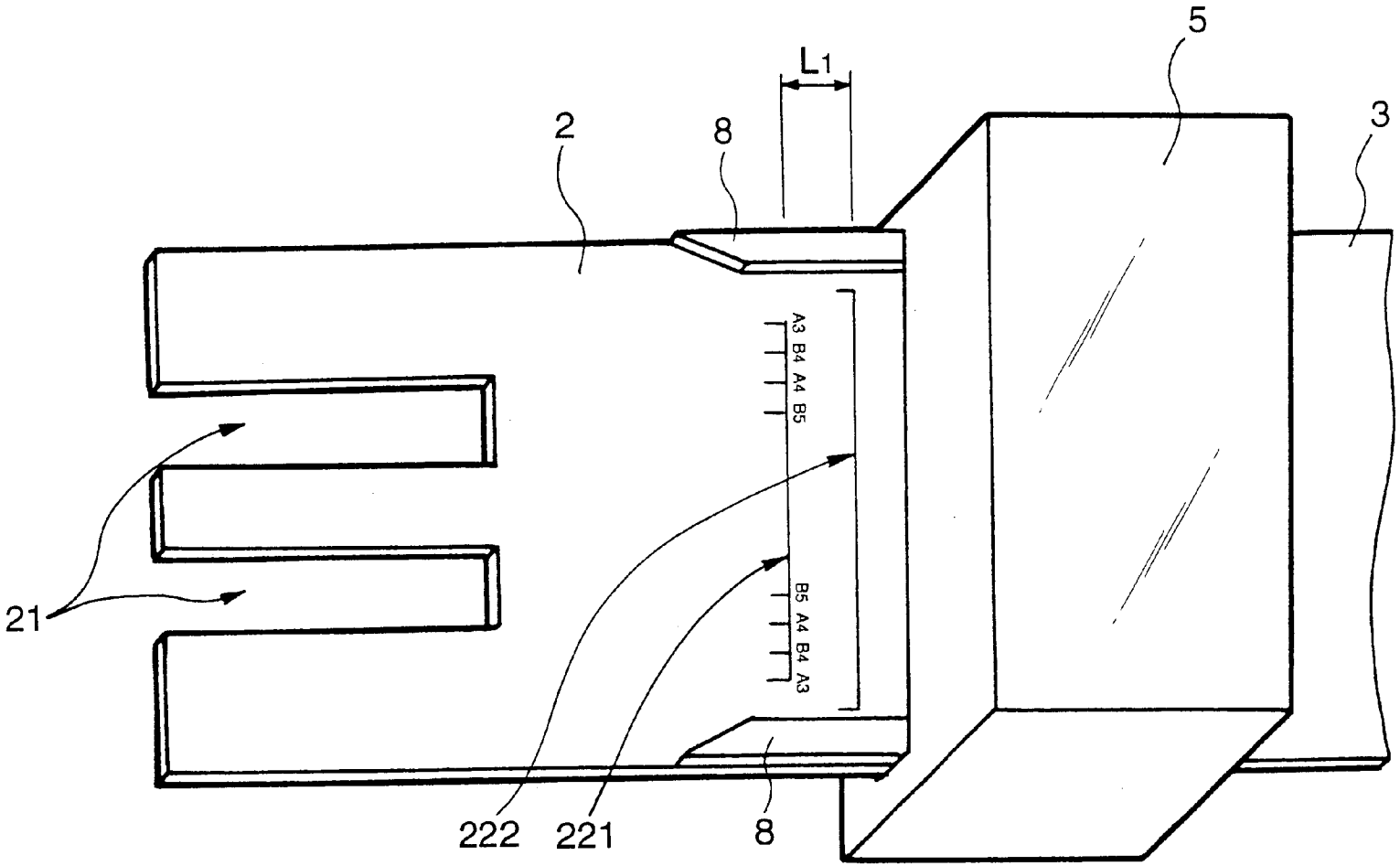
FIG. 3 is a diagram showing the main portion of the image transfer apparatus according to the second embodiment of the invention.

In view of this matter, the second embodiment shown in FIG. 3 is arranged to obviate this problem.

That is, as shown in FIG. 3, the second embodiment is characterized in that marks 221, 222 are provided on the insertion table 2 in correspondence with the positional relation of the image bearing sheet R and the image transfer sheet P. To be more concrete, the insertion table 2 is provided with the mark 221 having symbols A3, B4, A4 and B5 in correspondence with the sizes of sheets to be used, and also provided with the mark 222 at the position deviated by the length L1 toward the sheet conveying direction from the mark 221. The length L1 is about 21 mm.

In this embodiment, although the distance between the marks 221 and 222 is set to L1 irrespective of the sizes of the sheets (A3, B4, A4, B5), the distance may be changed in accordance with the size of the sheet. In the latter case, it will be convenient when the thickness of the line of the mark for the image transfer sheet may be changed or one of a dotted line, a thin line, a double line and a dot-and-dashed line is selectively employed as the mark for the image transfer sheet in correspondence with the size of the image bearing sheet such as B5 size, A4 size etc.

Further, the insertion table 2 is provided with notch portions 21 so that an operator can continuously hold the laminated sheets until the tip portions of the laminated two sheets on the head side thereof are nipped. Thus, the length of the notch portions 21 along the conveying direction of the sheets is preferably set to such a value that an operator can hold the image bearing sheet of the minimum size among all the image bearing sheets to be used until the tip portion of the laminated two sheets on the head side thereof is nipped by the heat rollers 41, 42.

A reference numeral 8 in FIG. 3 depicts sheet prevention plates with a thickness of about 1.5 mm. The sheet prevention plates 8 prevent the laminated sheets from moving out of the range of the heat rollers 41, 42.

FIGS. 4A to 4C and 4A' to 4C' show the procedure of inserting the laminated sheets into the image transfer apparatus using such marks 221, 222 and the notch portions 21.

① First, the image bearing sheet R is placed on the insertion table 2 in a manner that the image recording surface thereof is directed upward and the tip end thereof toward the conveying direction is aligned to the mark 221 of the insertion table 2 (FIGS. 4A, 4A').

② Then, the image transfer sheet P is placed on the image bearing sheet R such that the tip end thereof toward the conveying direction is aligned to the mark 222 of the insertion table 2 (FIGS. 4B, 4B').

③ Then, the rear end portions of the image bearing sheet R and the image transfer sheet P opposite to the conveying direction of the sheets are held by the hands in the laminated state in the notch portions 21 and then pushed into the image transfer apparatus (FIGS. 4C, 4C').

④ Thereafter, the laminated sheets are further pushed along the notch portions 21 while being held by the hands.

⑤ When the tip end portions of both the sheets toward the conveying direction are nipped by the heat rollers 41, 42 within the cover 5 of the image transfer apparatus, the sheets are taken off the hands.

According to the aforesaid procedure, since the laminated sheets can be inserted in a level state without being lifted, the sheets scarcely cause the wrinkles. Further, since the laminated sheets are nipped when the rear ends of the laminated sheets reach the end portions of the notch portions of the insertion table, an operator may take the hands off the sheets at this time.

Thereafter, when the laminated sheets are conveyed on the ejection table 3, an operator peels both the sheets from each other by the hands to remove the image transfer sheet. Thus, the image transfer procedure is completed.

In this manner, since the image transfer sheet is placed on the image bearing sheet, the moisture contained in the image transfer sheet can be evaporated therefrom upward and so the failure of the image transfer hardly occurs. Further, such a phenomenon scarcely occurs that the vapor stays between the image transfer sheet and the image bearing sheet to cause the extension or shrinkage of the image transfer sheet partially thereby to occur the image transfer failure.

According to the aforesaid reason, the method of the invention hardly causes wrinkles as compared with the conventional method 1, and is less in amount of the consumption of electric power and not necessary for using such a carrier which is expensive and complicated in its operation as compared with the conventional method 2.

Further, since the invention does not necessary to use a solid carrier, the conveying path for the sheets can be bent. Thus, since the conveying path for the sheets may be bent, the ejection table 3 may be disposed on the insertion side.

Figure 5:
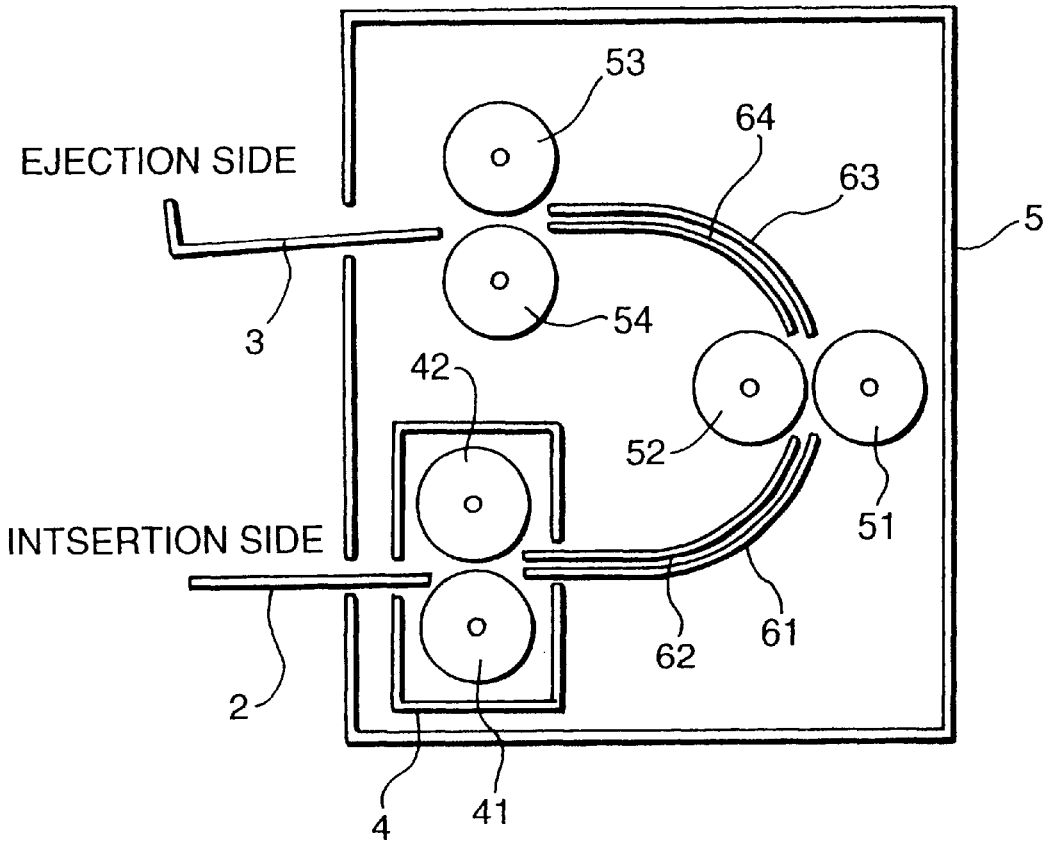
FIG. 5 is a sectional diagram of an image transfer apparatus which can curve the conveying path of the sheets according to the image transfer method of the invention.

FIG. 5 shows an image transfer apparatus wherein the ejection table 3 is disposed on the insertion side.

In FIG. 5, the image transfer apparatus is provided with a pair of heat rollers 41, 42 disposed in an opposed manner along the vertical direction, and a first pair of nip rollers 51, 52 and a second pair of nip rollers 53, 54 each pair being disposed at the downstream side of the heat rollers in an opposed manner along the vertical direction. A heat cover 4 surrounds the heat rollers 41, 42 to prevent the heat dissipation from the heat rollers 41, 42. Curved conveying guides 61, 62 are disposed between the heat rollers 41, 42 and the first pair of nip rollers 51, 52, and the curved conveying guides 63, 64 are disposed between the first pair of nip rollers 51, 52 and the second pair of nip rollers 53, 54. A protecting transfer cover 5 surrounds the heat cover 4, the first and second pair of nip rollers 51, 52, 53, 54 and the conveying guides 61, 62, 63, 64. An insertion table 2 is provided at the inlet side of the image transfer apparatus 1, and an ejection table 3 is provided at the ejection side thereof.

As described above, since such an image transfer apparatus does not necessary to use a solid carrier, the conveying guides 61, 62 and 63, 64 for the sheets can be bent. Thus, since the conveying guides for the sheets may be bent, the ejection side may be disposed on the insertion side. As a result, the depth of the image transfer apparatus can be made shorter and so the image transfer apparatus can be miniaturized to save the space thereof.

Figure 6:
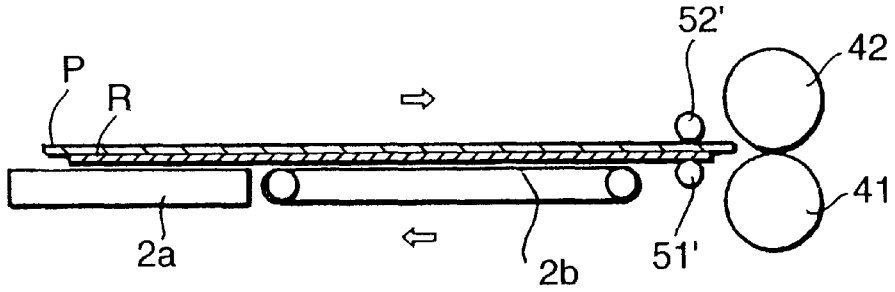
FIG. 6 is a diagram useful in explaining a principle of a third embodiment of the present invention.

FIG. 6 is a diagram useful in explaining a principle of a third embodiment of the present invention.

In FIG. 6, reference character R is indicates an image receiving sheet, and P indicates a main sheet placed on the image receiving sheet R. Reference numerals 51' and 52' are paired nip rollers, and 41 and 42 are paired heat rollers. In the image transfer apparatus 1 shown in FIG. 1, the cutouts 21 are formed in the insertion table 2. The image receiving sheet R and the main sheet P being superimposed one the other are held in a grip with the hands, and in this state the hands are moved along the cutouts toward the paired heat rollers 41 and 42. In the third embodiment, at least a portion 2*b* of the insertion table 2 is movable for sheet transportation by use of a belt conveyor. In the figure, reference numeral 2*a* is a non-movable portion of the insertion table.

In the third embodiment, an image receiving sheet R and a main sheet P, which have been positioned to each other in some way and superposed one on the other, are placed on the insertion table 2*a* and 2*b*. Then, the belt conveyor 2*b* is driven to convey the superimposed sheets in the direction of an arrow. The leading edges of the superimposed sheets are fed into the nip of the paired nip rollers 51' and 52'. Further, those sheets are transported to the paired heat rollers 41 and 42.

Figure 7:
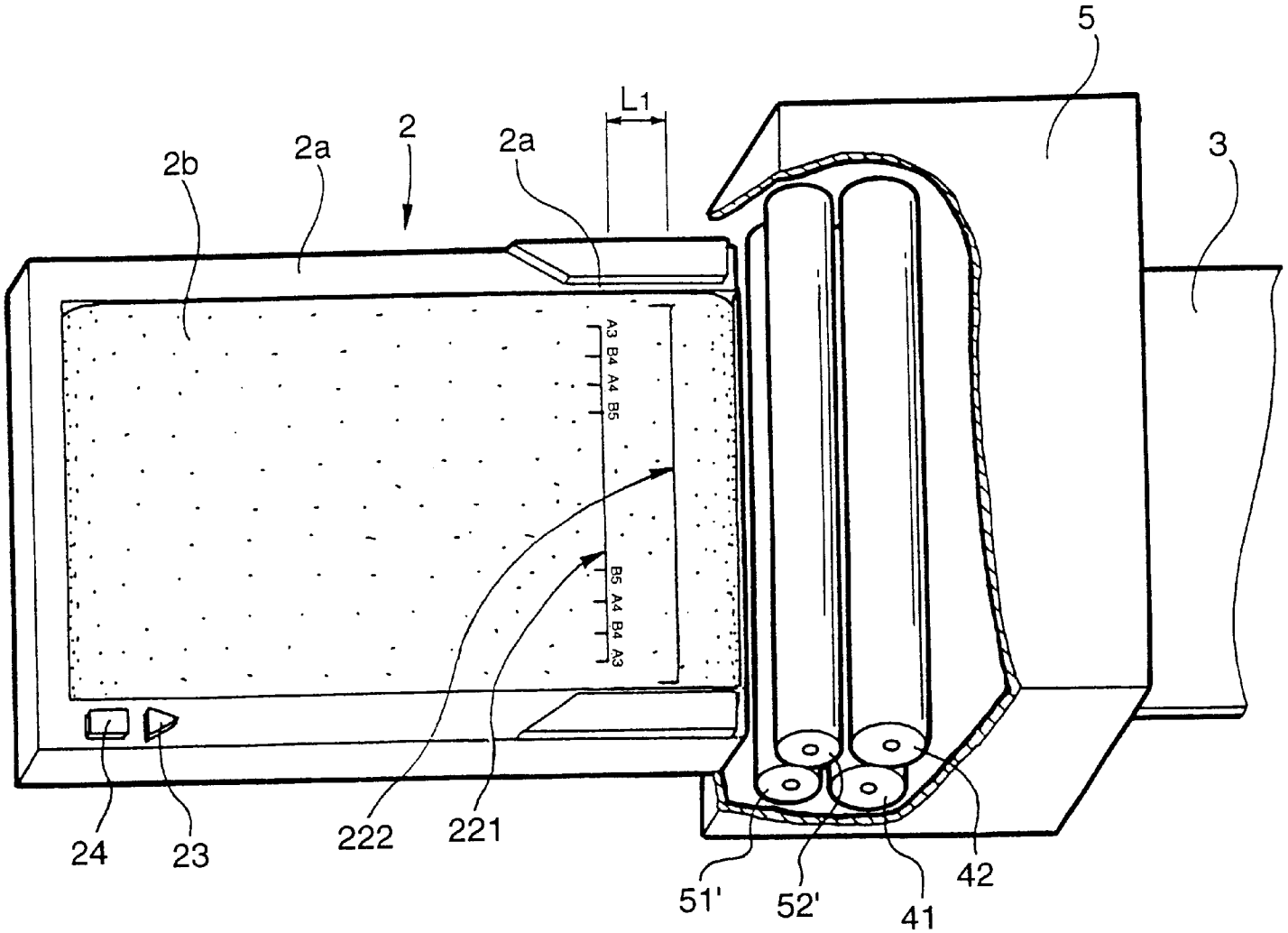
FIG. 7 is a diagram showing a specific implementation of the principle of the third embodiment.

FIG. 7 is a diagram showing a specific implementation of the principle of the third embodiment.

In the figure, reference numeral 2 is an insertion table; 3 is a discharge table; and 5 is a cover for the image transfer apparatus. Paired nip rollers 51' and 52', and paired heat rollers 41 and 42 (sheet-discharging nip rollers are concealed in the figure) are covered with the cover 5. The insertion table 2 includes a frame portion 2*a* and a belt conveyor 2*b*. A power switch 24 for a motor for driving the belt conveyor 2*b* and a start button 23 are provided at a corner of the frame portion 2*a* of the insertion table. When the start button 23 is pushed once, the belt conveyor starts to move. When it is pushed again, the belt conveyor stops its movement. When it is pushed another time, the belt conveyor starts to move. When it is further pushed, the belt conveyor stops its movement. Those operations are repeated to feed the superimposed sheets to the nip of the nip roller pair. Marks 221 and 222 described in connection with FIG. 4 are formed onto the belt conveyor 2*b*.

How to use the image transfer apparatus of FIG. 7 will be described.

An image receiving sheet R is first set along the mark 221 on the belt conveyor 2*b* in a state that its recording surface is faced upward. Then, a main sheet P is put on the image receiving sheet R in a state that it is set along the mark 222. In this state, the start button 23 is depressed, and the belt conveyor 2*b* starts to move, and moves the superimposed sheets R and P toward the paired nip rollers 51' and 52'. When the belt conveyor 2*b* passes its turning point and moves downward, the leading edges of the superimposed sheets horizontally moves forward by their rigidity, and nipped with the nip rollers 51' and 52'. The belt conveyor 2*b* continues its movement, and when the marks 221 and 222 reach their original positions, the belt conveyor automatically stops.

Thus, the superimposed sheets may automatically be inserted into the nip of the nip rollers 51' and 52" while keeping their horizontal attitude. Therefore, the superimposed sheets are little bent and hence substantially free from formation of creases.

Figure 8:
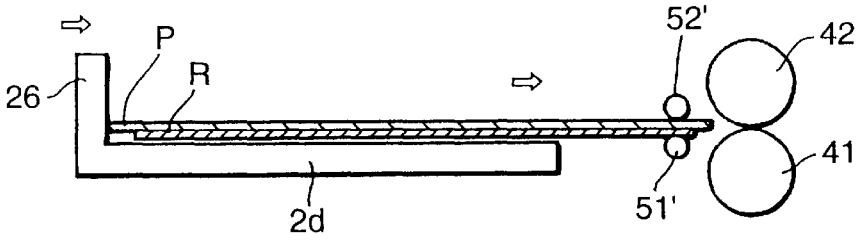
FIG. 8 is a diagram useful in explaining a principle of a fourth embodiment of the present invention.

FIG. 8 is a diagram useful in explaining a principle of a fourth embodiment of the present invention.

In FIG. 6, reference character R is an image receiving sheet, and P is a main sheet placed on the image receiving sheet R. Reference numerals 51' and 52' are paired nip rollers, and 41 and 42 are paired heat rollers. In the image transfer apparatus 1 shown in FIG. 1, the cutouts 21 are formed in the insertion table 2. The image receiving sheet R and the main sheet P being superimposed one the other are held in a grip with the hands, and in this state the hands are moved along the cutouts toward the paired heat rollers 41 and 42. In the fourth embodiment, the insertion table 2 is formed with a slide table 2*d* and a handle 26.

In the fourth embodiment, an image receiving sheet R and a main sheet P, which have been positioned to each other in some way and superposed one on the other, are placed on the slide table 2*d* of the insertion table. Then, the slide table 2*d* is moved, by handling the handle 26 with the hand, to transport the superimposed sheets in the direction of an arrow. The leading edges of the superimposed sheets are fed into the nip of the paired nip rollers 51' and 52'. Further, those sheets are transported to the paired heat rollers 41 and 42.

Figure 9:
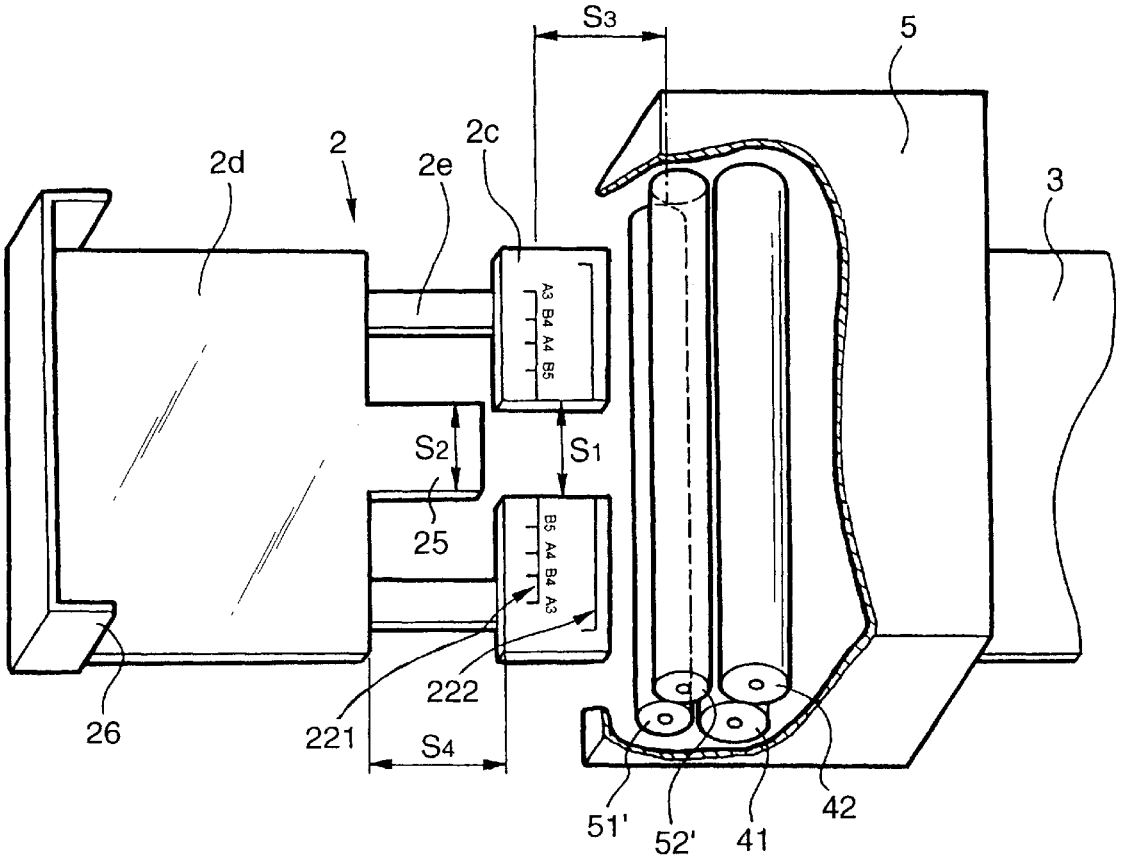
FIG. 9 is a diagram showing a specific implementation of the principle of the fourth embodiment.
Figure 10:
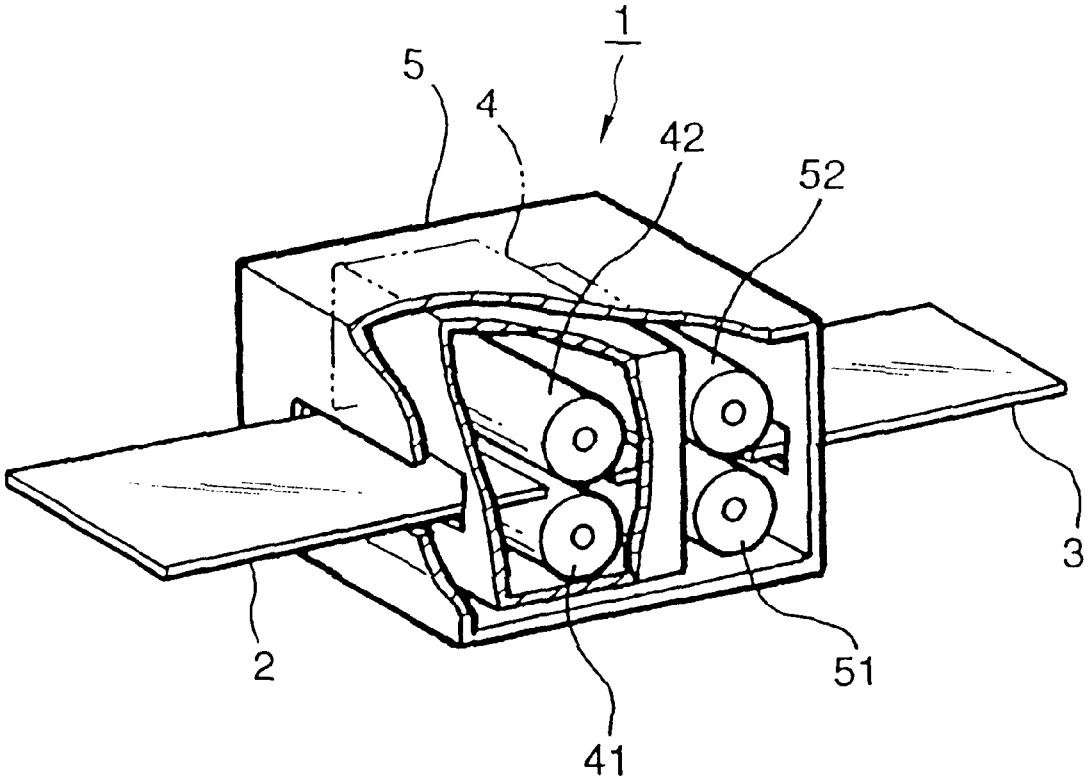
PRIOR ART FIG. 10
FIG. 10 is a partially sectional perspective view showing an example of the conventional image transfer apparatus.
Figure 11:
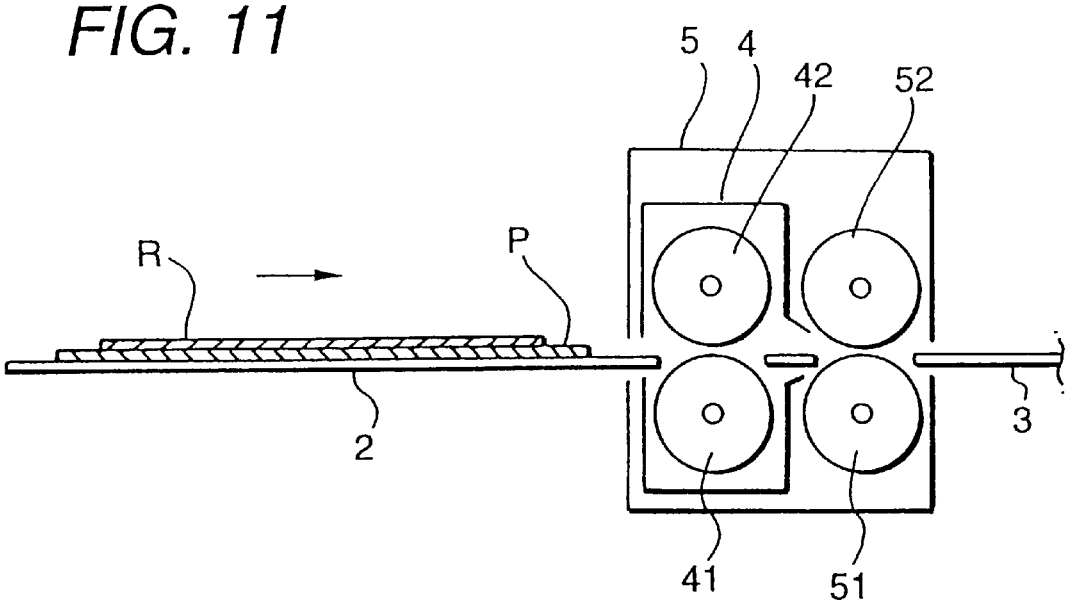
PRIOR ART FIG. 11
FIG. 11 is a diagram for explaining the first conventional image transfer method using the image transfer apparatus shown in FIG. 10.
Figure 12:
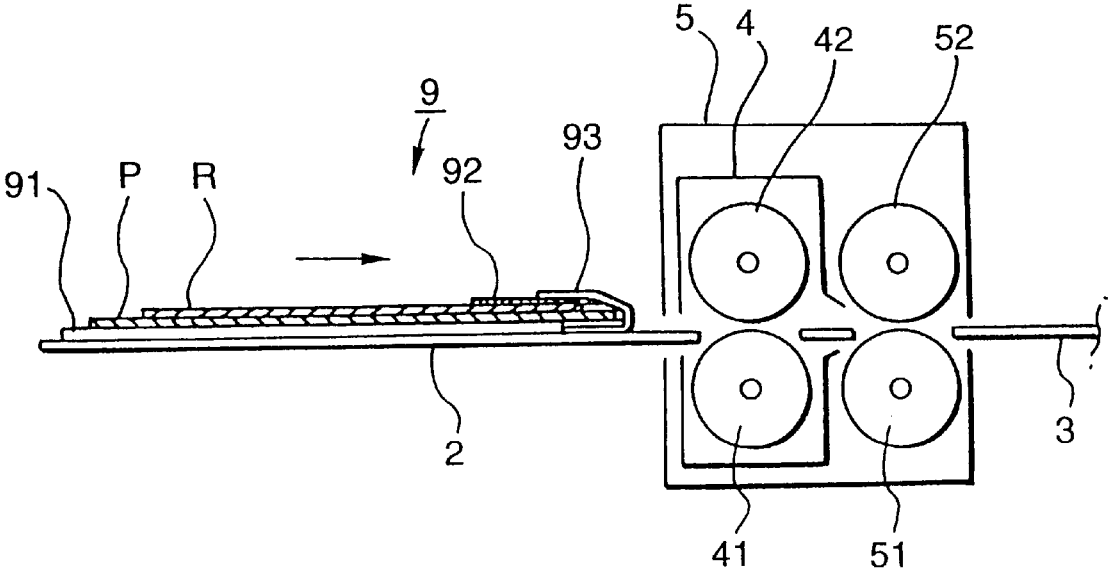
FIG. 12 is a diagram for explaining the second conventional image transfer method using the image transfer apparatus shown in FIG. 10.

FIG. 9 is a diagram showing a specific implementation of the principle of the fourth embodiment.

In the figure, reference numeral 2 is an insertion table; 3 is a discharge table; and 5 is a cover for the image transfer apparatus. Paired nip rollers 51' and 52', and paired heat rollers 41 and 42 (sheet-discharging nip rollers are concealed in the figure) are covered with the cover 5. The insertion table 2 includes non-movable tables 2*c*, a slide table 2*d*, slide-table guide rails 2*e*, and the handle 26 which, while standing erect, is located at the end of the slide table 2*d*. The non-movable tables 2*c* are made of a material which has small friction and is easy to slip, and are spaced from each other in the direction perpendicular to a sheet advancing direction. Marks 221 and 222, which were described in connection with FIG. 4, are formed on the non-movable tables 2*c*. An extended portion 25 is extended from the leading end of the slide table 2*d* when viewed in the sheet advancing direction. The extended portion 25 is provided supporting the underside of the superimposed sheets R and P, and has a width S2 as viewed in the direction perpendicular to the sheet advancing direction. The width S2 is somewhat smaller than the S1. The slide table 2*d* is slidable in the sheet advancing direction on and along the slide-table guide rails 2*e*. When the image transfer apparatus starts its operation, the slide table 2*d* is spaced from the non-movable tables 2*c* by a distance S4, as shown. A distance S3 between the leading-edge mark 221 of the image receiving sheet R and a nip position of the nip roller pair 51' and 52' is smaller than the distance S4. Therefore, when the image receiving sheet R positioned to the mark 221 is transported the distance S4 in the advancing direction, the leading edge of the image receiving sheet R will be caught with the paired nip rollers 51' and 52' during its advancing movement.

Now, how to use the image transfer apparatus of FIG. 9 will be described.

An image receiving sheet R is first set along the mark 221 on the slide table 2*d* in a state that its recording surface is faced upward. Then, a main sheet P is put on the image receiving sheet R in a state that it is set along the mark 222. In this state, the user touches the handle 26 and pushes it in the sheet advancing direction. The superimposed sheets are moved while being placed on the slide table 2*d*. Those sheets move forward without any bending of the leading edges of the sheets because of their rigidity, and will be caught with the nip rollers 51' and 52'. In this case, it is preferable to place a light weight on the main sheet P laid on the image receiving sheet R. If so done, the sheets positioned to each other are not shifted from each other, and will reliably be nipped with the nip rollers 51' and 52'.

As described above, in the fourth embodiment, after the image receiving sheet R and the main sheet P, which have been positioned to each other and superimposed one on the other, are placed on the slide table 2*d*, the slide table 2*d* is moved. Accordingly, the superimposed sheets are reliably fed into the nip between the nip rollers 51' and 52', and those sheets are little creased.

As described above, the invention thus configured can attain the following technical advantages.

① Wrinkles can be prevented from being caused.

② Since the image bearing sheet is placed on the insertion table in a manner that the image recording surface thereof is directed upward, dust etc. on the image can be easily removed before the sheets are inserted. Further, the state of the image on the image bearing sheet can be confirmed before the image transfer procedure.

③ Since it is not necessary to use a carrier, the ejection portion can be disposed at the insertion side. Thus, the depth of the image transfer apparatus can be made shorter and so the image transfer apparatus can be miniaturized to save the space thereof.

What is claimed is:

1. In an image transfer method wherein an image bearing sheer on which an image is formed and a sheet on which an image is to be transferred are laminated, and the two sheets thus laminated are passed between a pair of heat rollers from an insertion table thereby to transfer the image formed on the image bearing sheet on the sheet on which the image is to be transferred, said method comprising the steps of:

placing the image bearing sheet on said insertion table;

laminating the sheet on which an image is to be transferred on the image bearing sheet; and inserting the two sheets thus laminated between said pair of heat rollers, wherein said step of insetting is a step of inserting the sheet and the image bearing sheet so that the sheet takes precedence over the image bearing sheet by a constant length, wherein said constant length is set so as to prevent a failure of the sheet and the image bearing sheet feeding called "jam".

2. An image transfer method according to claim 1, wherein said insertion table is provided with marks thereon corresponding to a positional relation of the image bearing sheet and the sheet on which and image is to be transferred, said two sheets are inserted according to the marks.

3. An image transfer method according to claim 1, wherein an image bearing surface of said image bearing sheet faces away from said insertion table.

4. In an image transfer method wherein an image bearing sheet on which an image is formed and a sheet on which an image is to be transferred are laminated, and the two sheets thus laminated are passed between a pair of heat rollers from an insertion table thereby to transfer the image formed on the image bearing sheet on the sheet on which the image is to be transferred, said method comprising the steps of:

placing the image bearing sheet on said insertion table;

laminating the sheet on which an image is to be transferred on the image bearing sheet; and inserting the two sheets thus laminated between said pair of heat rollers, wherein from the beginning of said inserting step, until tip portions of the two sheets thus laminated are nipped by an operator.

5. An image transfer apparatus method according to claim 4, wherein said insertion table includes notch portions are arranged in a manner that an operator can hold the two sheets thus laminated.

6. An image transfer method according to claim 4, wherein an image bearing surface of said image bearing sheet faces away from said insertion table.

7. In an image transfer method wherein an image bearing sheet on which an image is formed and a sheet on which an image is to be transferred are laminated, and the two sheets thus laminated are passed between a pair of heat rollers from an insertion table thereby to transfer the image formed on the image bearing sheet on the sheet on which the image is to be transferred, said method comprising the steps of:

placing the image bearing sheet on said insertion table;

laminating the sheet on which an image is to be transferred on the image bearing sheet; and inserting the two sheets thus laminated between said pair of heat rollers, wherein the image bearing sheet and the sheet on which an image is to be transferred are laminated in such a positional relation that the sheet on which an image is to be transferred is inserted between said pair of heat rollers prior to the image bearing sheet by a length of 21 mm or more.

* * * * *